US006336897B1

(12) United States Patent
Mackin

(10) Patent No.: US 6,336,897 B1
(45) Date of Patent: Jan. 8, 2002

(54) GROMMET FOR INFANT CARE APPARATUS

(75) Inventor: Michael H. Mackin, Ellicott City, MD (US)

(73) Assignee: Datex-Ohmeda, Inc., Tewksbury, MA (US)

( * ) Notice: Subject to any disclaimer, the term of this patent is extended or adjusted under 35 U.S.C. 154(b) by 0 days.

(21) Appl. No.: 09/503,074

(22) Filed: Feb. 12, 2000

Related U.S. Application Data

(60) Provisional application No. 60/170,279, filed on Dec. 11, 1999.

(51) Int. Cl.[7] ..... A61G 11/00; E05G 3/14
(52) U.S. Cl. ..... 600/22; 292/242
(58) Field of Search ..... 392/403; 16/2.2; 248/56; 600/22

(56) References Cited

U.S. PATENT DOCUMENTS 4,640,479 A * 2/1987 Shely et al. ..... 248/56
5,224,923 A * 7/1993 Moffett et al. ..... 600/22
5,474,517 A 12/1995 Falk et al.
5,878,190 A * 3/1999 Gloyd et al. ..... 392/403
6,119,305 A * 9/2000 Loveall et al. ..... 16/2.2

* cited by examiner

*Primary Examiner*—Eric F. Winakur
*Assistant Examiner*—Nikita R Veniaminov
(74) *Attorney, Agent, or Firm*—Roger M. Rathbun

(57) ABSTRACT

An infant care apparatus is provided that includes a specially designed grommet in order to facilitate the introduction of wires and/or tubes through a wall in the infant care apparatus so that wires and/or tubes can be passed through the wall for use with the infant positioned within the infant apparatus and contained with the wall or walls. The grommet is located in one of the walls surrounding the infant and includes a slit formed in a flexible material and where the slit is oriented vertically. The flexible material has a plurality of spaced apart thickened ridges that create barriers to the ease of movement of the wires or tubes along the slit. The thickened ridges preferably are formed in pairs and extend outwardly bidirectionally from the slit and may be tapered inwardly in the direction toward the slit. Thus, a wire or tube may be slid vertically along the slit and located at a desired area between any of the thickened ridges and not interfere with other wires or tubes. Tubes and/or wire can thus be located at various vertical heights above the infant bed and will stay firmly in the desired position, but can be readily moved to another vertical position by a slightly higher exertion of force by the user to force the wire or tube past a pair of thickened ridges.

11 Claims, 5 Drawing Sheets

GROMMET FOR INFANT CARE APPARATUS

RELATED APPLICATIONS

This application is based upon Provisional Patent Application Ser. No. 60/170,279 filed Dec. 11, 1999.

BACKGROUND

The present invention relates to an infant care apparatus and, more particularly, to a grommet for introducing tubes and wires through a wall of an infant care apparatus.

There are, of course, many devices or apparatus for the care of an infant and, among such differing such apparatus, there are infant warmers that are basically planar surfaces on which the infant is positioned and which planar surfaces generally include side guards to keep the infant safely within the confines of the apparatus.

There are also infant incubators and which are more confined enclosures that contain the infant within an enclosed controlled atmosphere that provides heat to the infant and also may provide control of humidity in the enclosed environment.

With either type of infant care apparatus as well as potentially other types of apparatus that may provide a means of care to an infant, the apparatus generally includes a plurality of side walls that are used to enclose the infant. With an incubator, the walls fully enclose the infant and surround the infant on all four sides to provide the protective environment within the infant compartment. With an infant warmer, the infant is more likely positioned upon a planar surface with an overhead radiant heater providing infrared radiation to impinge upon the infant and the walls are more in the shape of protective side guards to enclose the and keep the infant safely restrained on the surface. Such protective side guards of an infant warmer are generally, as with an incubator, also positioned along all of the entire periphery of the planar surface and removable to a position enclosing the infant on the surface or can be moved to an open position where more access can be gained to the infant. An example of such side guards in an infant warmer is shown and described in U.S. Pat. No. 5,474,517 of Falk et al.

For purposes of the present description of the invention, although somewhat different in actual functioning, the walls of an infant incubator and the protective guards of an infant warmer will hereinafter be referred to generically as walls and the applicability of the present invention to both types of infant care apparatus will be readily seen, as well as the applicability to other types of similar apparatus.

In dealing with infants in either type of equipment, there is a need to provide monitors or supply fluids to the infant and thus, it is necessary to have a plurality of wires, cables and/or various tubes that are attached to the infant or located near the infant where some device attached to the cable of tubing can be easily accessed to administer treatment to the infant. One typical tube used for the present purpose is a ventilator tube that is affixed to the infant and is used to access the infant to ventilate the infant and therefore it is desirable to be able to position the ventilator tube as it passes through the wall of the incubator or warmer to be at a certain height above the infant bed depending upon the location of the infant and the tilt position of the bed. Thus, in the case of an incubator, the tubes and wires must pass through the walls of the incubator that enclose the infant and, in the case of an infant warmer, the same need is present, that is, it is convenient to provide a management of the various tubes and wires to insure they are properly affixed to the apparatus and yet can be individually passed through the walls in a logical and controlled manner such that the ends of the wires or tubes are affixed to or near the infant.

At the present, there are a variety of devices that are located in the walls of the incubator to allow the wires or tubes to pass through the wall. One of such devices is a slitted grommet where the wires or tubes are passed through a slit formed in a flexible plastic grommet. The grommet is preferable oriented in the upper portion of the wall such that he wires of tubes can be introduced into the vertically oriented slit by passing the wires or tubes downwardly into the slit that is accessible through the upper edge of the wall.

While reasonably suited to the purpose, the grommet must be positioned in the wall of the infant care apparatus, as explained, so that the slit is vertically oriented to allow the introduction or wires and tubes into the slit through the upper edge of the walls. Such orientation, however, creates an inherent problem in that all of the wires and tubes end up at the bottom of the slit and become tangled with each other. Thus, the wire and tubes are entangled and the management of the individual wires or tubes becomes difficult to manage in the event one or more of the tubes or wires needs to be moved or removed from the grommet. In addition, there is no selectivity available to readily enable the user to locate a tube, such as a ventilator tube, at a desired height above the infant bed, particularly with an incubator bed that tilts.

Thus, it would be advantageous to provide a grommet that would allow the introduction of a plurality of wires and tubes through the walls of an incubator by passing the wire or tubes within a vertically oriented slit in the grommet and yet would allow each of the wires or tubes to be individually isolated so as to maintain order among the wire and tubes as well as provide some selectivity to the user to locate a tube or wire at differing heights above the infant bed.

SUMMARY OF THE INVENTION

Accordingly, the present invention relates to an infant care apparatus that has various walls to contain the infant and has a grommet that is provided in at least one of those walls to allow the wires and the tubes to pass through the wall to the interior of the infant compartment to be used with monitors or other devices used in the caring of the infant. In the present invention, the grommet includes a slit through which the wires and tubes can be positioned and the slit is generally elongated and oriented in a generally vertical position in the wall.

Accordingly, the wires and/or tubes can be moved along the slit as in the conventional grommets, however, there is also provided a plurality of spaced thickened ridges, preferably formed in the flexible plastic grommet material and which thickened ridges create spaced areas where the wires and tubes can be supported by the thickened ridges so as to separate the wires and tubes as desired by the user.

The thickened ridges still allow the wires and the tubes to be slid past the ridges by an extra effort on the part of the user so that the user can selectively move the particular wire or tube to be supported on the desired thickened ridge and the user can force the wire or the tube past the ridge to arrive at the selected location of the desired ridge. Thus, the flexible plastic grommet serves to create spaced areas where wire and tubes can be managed and located independent of each other.

As one of the major advantages of such selective vertical positioning, the user can place a ventilator tube that is positioned in the mouth of the infant in a vertical desire position so as to be convenient to the infant and maintained in that position. In the event, however, that the infant bed is tilted, the position of the ventilator tube in the grommet can be changed to another height and still maintain that convenient location for use with the infant even with the infant bed tilted to the various angles. In addition, as a secondary advantage, the use of the present grommet can be used to position a plurality of wires and tubes to pass through the sides of the infant apparatus at vertical separations and thus avoid creating a bundle of mixed wires and tubes at the bottom of the vertical slit.

Accordingly, with the grommet of the present invention, the advantageous properties of having a vertically aligned slit for introducing and positioning wires or tubes to pass through a wall are present but in addition, a tube to the infant can remain in a desired location despite tilting of the infant bed and, additionally, the various myriad of wires and tubes can be selective separated into particular groups designated by the user, thus, the user can locate all of the tubes at one location supported by one of the thickened ridges while having the wires spaced from that group of tubes and supported at another of the thickened ridges. Additionally, with the use of the present invention, the user can selectively choose a vertical position for the tubes or wires to facilitate a particular position of the infant or tilt angle of the infant bed.

These and other features and advantages of the present invention will become more readily apparent during the following detailed description taken in conjunction with the drawings herein.

DETAILED DESCRIPTION OF THE INVENTION

Figure 1:
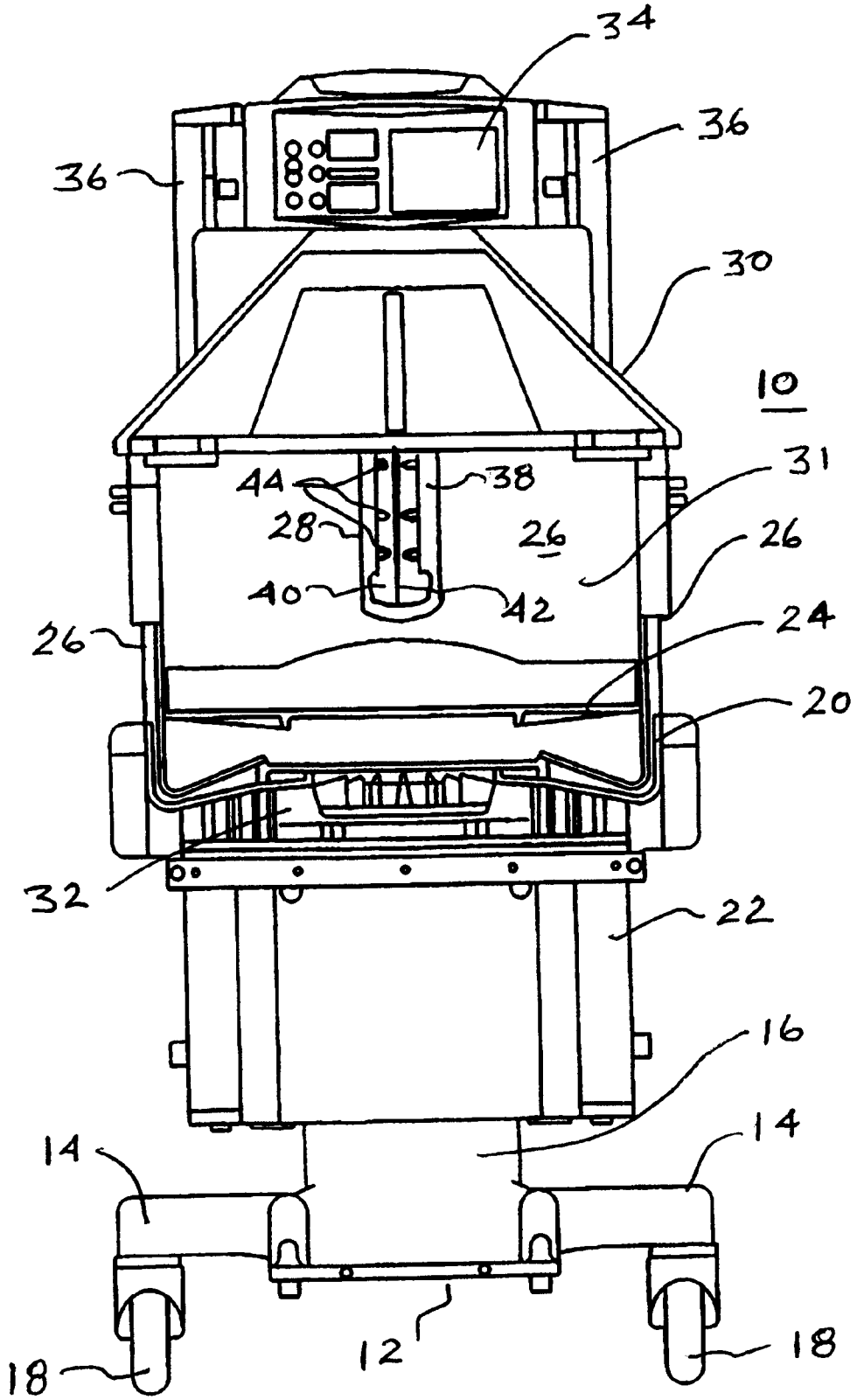
FIG. 1 is an end view of an infant care apparatus employing a grommet constructed in accordance with the present invention.

Referring now to FIG. 1, there is shown an end view of an infant care apparatus 10 constructed so as to use the present invention. As will be seen, the present description will be with reference specifically to an infant incubator as the infant care apparatus, however, it will become obvious that the present invention can readily be used with other infant care apparatus such as an infant warmer as shown and described in the aforementioned U.S. Patent of Falk et al.

Thus, in the Figs, the infant care apparatus 10 includes a base 12 comprising a pair of U-shaped members 14 that are joined together and which provide support for a stationary base member 16. Wheels 18 may also be provide for ready movement of the infant care apparatus 10.

An infant platform 20 is provided and which supports an infant in the infant care apparatus 10 and the infant platform 20 may be mounted to a vertical movable member 22 in a manner such that the user can adjust the height of the infant platform 20 by raising and lowering the movable vertical member 22 with respect to the stationary vertical base member 16 to the preferred height by the user. The infant platform 20 includes a flat, planar surface 24 that actual underlies the infant when positioned with the infant care apparatus 10. Extending upwardly around the periphery of the infant platform 20 are a plurality of walls 26, normally of a transparent plastic material and which surround the flat planar surface 24 to enclose the infant on the flat, planar surface 24 that forms a bed for the infant. As can be seen, the walls 26 surround all four sides of the generally rectangular shaped infant platform 20 to enclose the infant in the controlled environment. As can also be seen, there is a grommet 28 located in the rear wall 26 of the infant care apparatus 10.

A hood 30 covers the upper peripheral edges of the walls 26 to enclose therein an infant compartment 31 that provides a controlled environment by supplying heat and humidity to aid in the development and well being of the infant.

A heating and air moving compartment 32 is located within the infant platform 20 beneath the flat, planar surface 24 on which the infant is positioned and within the heating and air moving compartment 32 there is located a convective heating system along with the various ducting that directs the air up to within the infant compartment 30.

A control module 34 is conveniently positioned intermediate a pair of frame members 36 and may include displays of various monitored parameters as well as include the various controls for operation of the functions of the infant care apparatus 10.

Returning to the grommet 28, it can be seen the grommet 28 is located in the rear wall 26 of the infant care apparatus 10 and comprises a frame 38 within which is located a flexible material 40, such as a molded elastomer. A slit 42 is formed in the molded elastomer material 40 and there are a plurality of thickened ridges 44, the purposes of which will be later explained.

Figure 2:
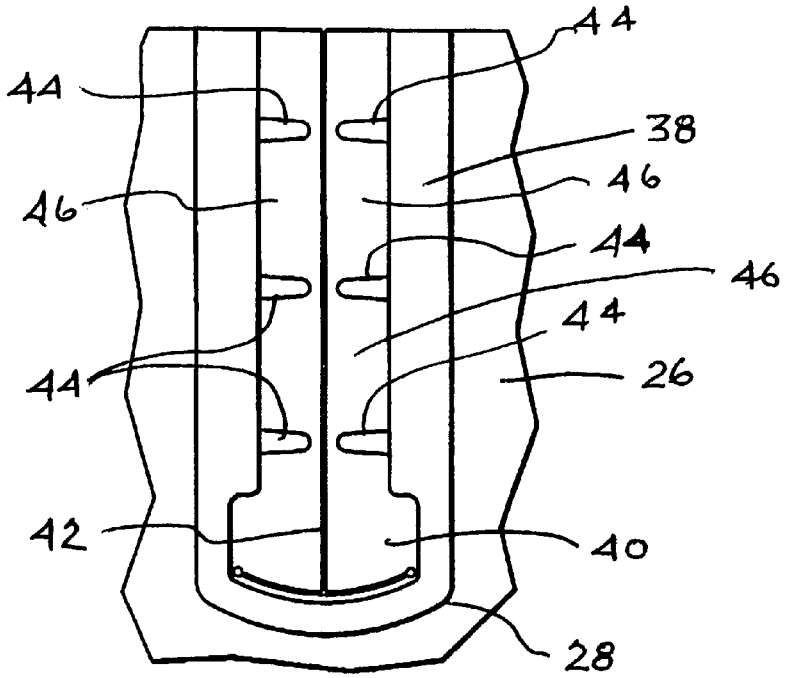
FIG. 2 is an enlarged side view of the grommet of the present invention.

Turning now to FIG. 2, there is shown an enlarged side view of the grommet 28 of FIG. 1. As can be seen, the grommet 28 is fitted into the wall 26 of the infant care apparatus and, in this embodiment, the grommet 28 can, in conventional manner, be slid downwardly into a slot formed vertically in the upper edge of the wall 26. Th grommet 28 itself includes the frame 38 which is generally formed of a relatively firm injection molded plastic and normally has an elongated indentation along its outer edges to allow it to fit over and into the slot formed by the wall 26 and be retained thereto.

Internally formed in the frame 38, is a more resilient plastic or thinner material so that the flexible material 40 can flex as a wire or tube is passed vertically along the slit 42 to position that tube or wire within the grommet 28 to pass through the wall 26 in the apparatus. As can also be seen in this Fig., there are formed a plurality of thickened ridges 44 in the flexible material 40 and which are preferably oriented horizontally in pairs and which extend outwardly from the slit 42. In the preferred embodiment, the thickened ridges 44 are molded into the material 40 and are formed so as to have their cross sections taper inwardly in the direction of the slit 42 so that the thickened ridges 44 are sufficiently strong yet provide a certain resistance to the movement of wires or tubes along the length of the slit 42.

Thus, the presence of the thickened ridges 44 creates lesser resistance areas 46 along the length of the slit 42 where wires or tubes may be positioned by the user and which cause those wires or tubes to stay in the particular area 46 desired by the user. Due to the thickened ridges 44, the wires or tubes will not fall down to the bottom of the vertically oriented slit 42 to become tangled or intermingled with other wires and tubes and an individual wire or tube can be retained in a particular vertically spaced area located along the grommet 28 as desired by the user to maintain management and order of the various wires and tubes.

Figure 3:
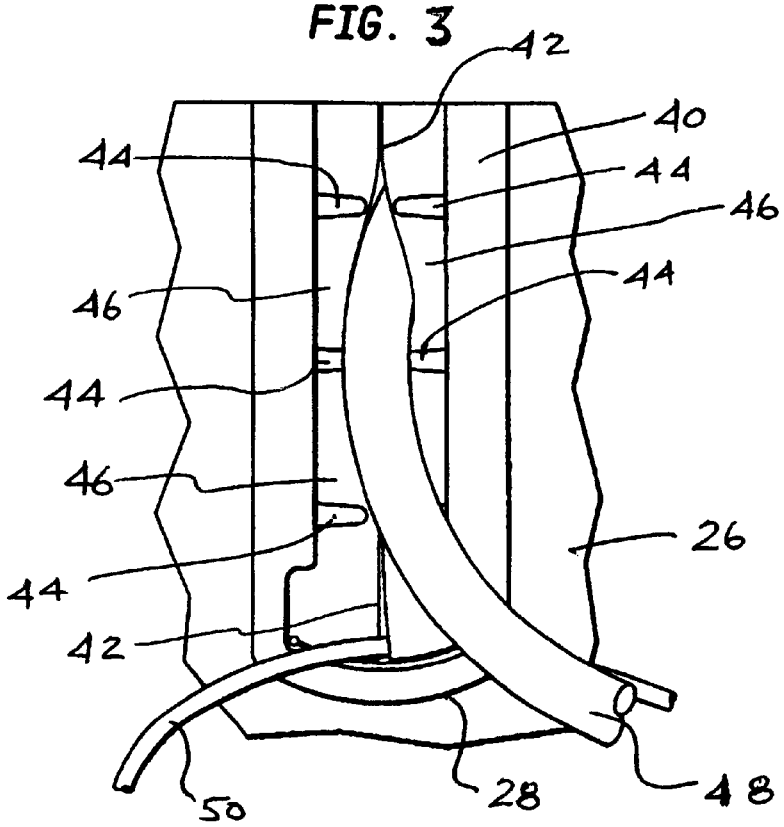
FIG. 3 is an enlarged side view of the grommet of FIG. 2 with a tube and a wire passing through the grommet.

Turning now to FIG. 3, there is shown an enlarged side view of a grommet 28 positioned within a wall 26 of the infant care apparatus and having a tube 48, such as a ventilator tube, and a wire 50 passing through the slit 42 so that the tube 48 and wire 50 can enter into the infant compartment 31 (FIG. 1) to be accessible for use with the infant contained therein. In this embodiment the infant care apparatus is generally an infant warmer or other apparatus where the upper edge of the wall 26 is thus available so that the slit is open to the external environment of the infant care apparatus and the tube 48 or wire 50 can simply be inserted into the slit 42 entering the upper extremity of the grommet 28 and pushing the wire or tube downwardly to enter and move vertically downwardly along the slit 42.

As can be seen in this Fig., the tube 48 is retained at one of the upper areas 46 and as will be seen, the use of a tube 48 as a ventilator tube to supply breathing air to the infant from a ventilator is preferably capable of being positioned at differing heights above the infant bed or flat, planar surface as determined by the user based upon the location of the infant and/or the tilt position of the bed.

Thus, with the present invention and the use of the thickened ridges 44, the tube 48 can be slid downwardly in the slit 42 to the first set of thickened ridges 44 and will stay in that position by the thickened ridges 44 so that the tube 48 will be retained at a greater height off the infant bed than, for example, the wire 50 or with respect to other tubes and/or wires. The wire 50, on the other hand, can be slid past the thickened ridges 44 by a slightly higher force exerted by the user and thus can be located at the lower extremity of the slit 42, well out of the way of the tube 48.

Figure 4:
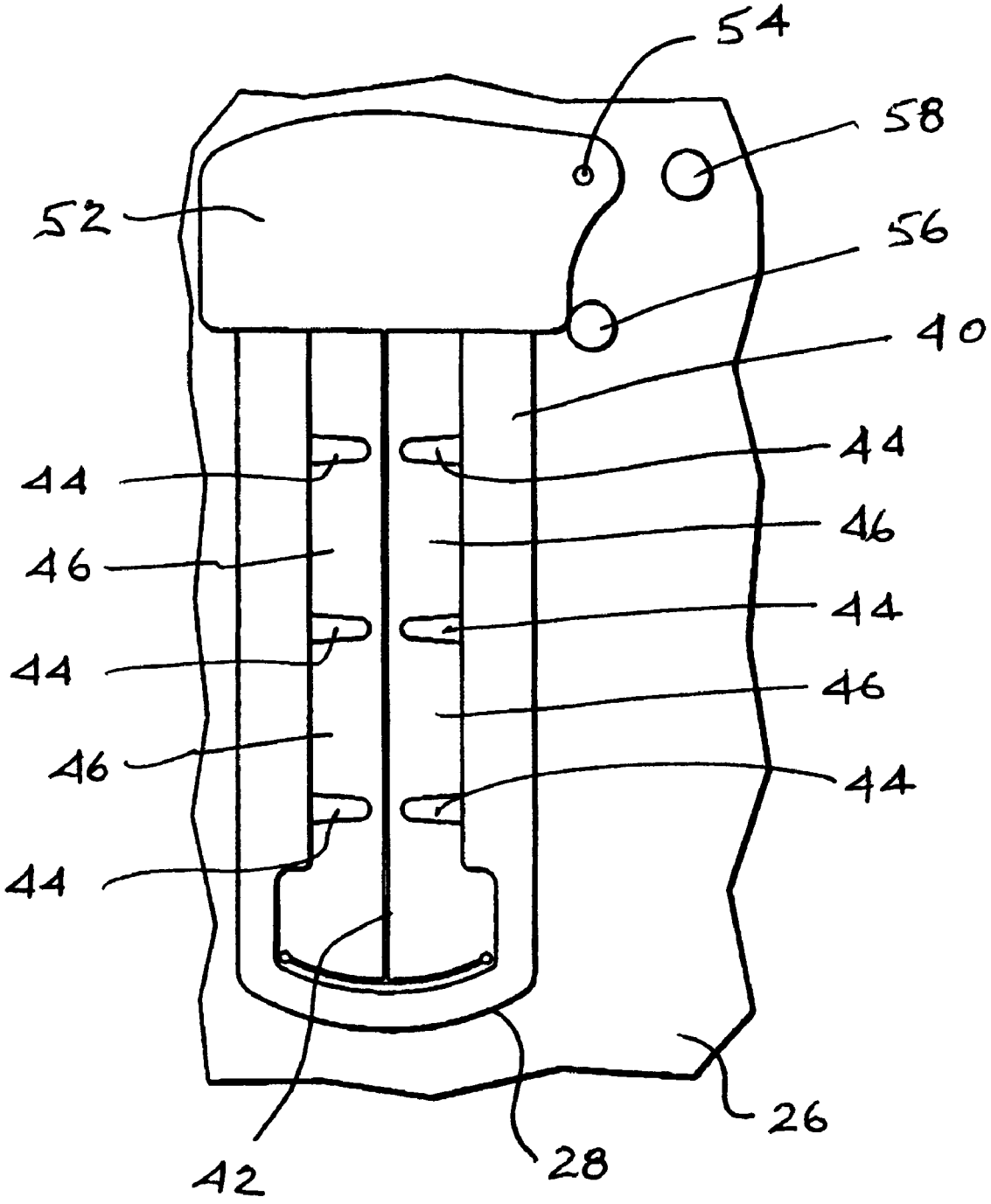
FIG. 4 is an enlarged side view of an alternate embodiment of the grommet of the present invention.
Figure 5:
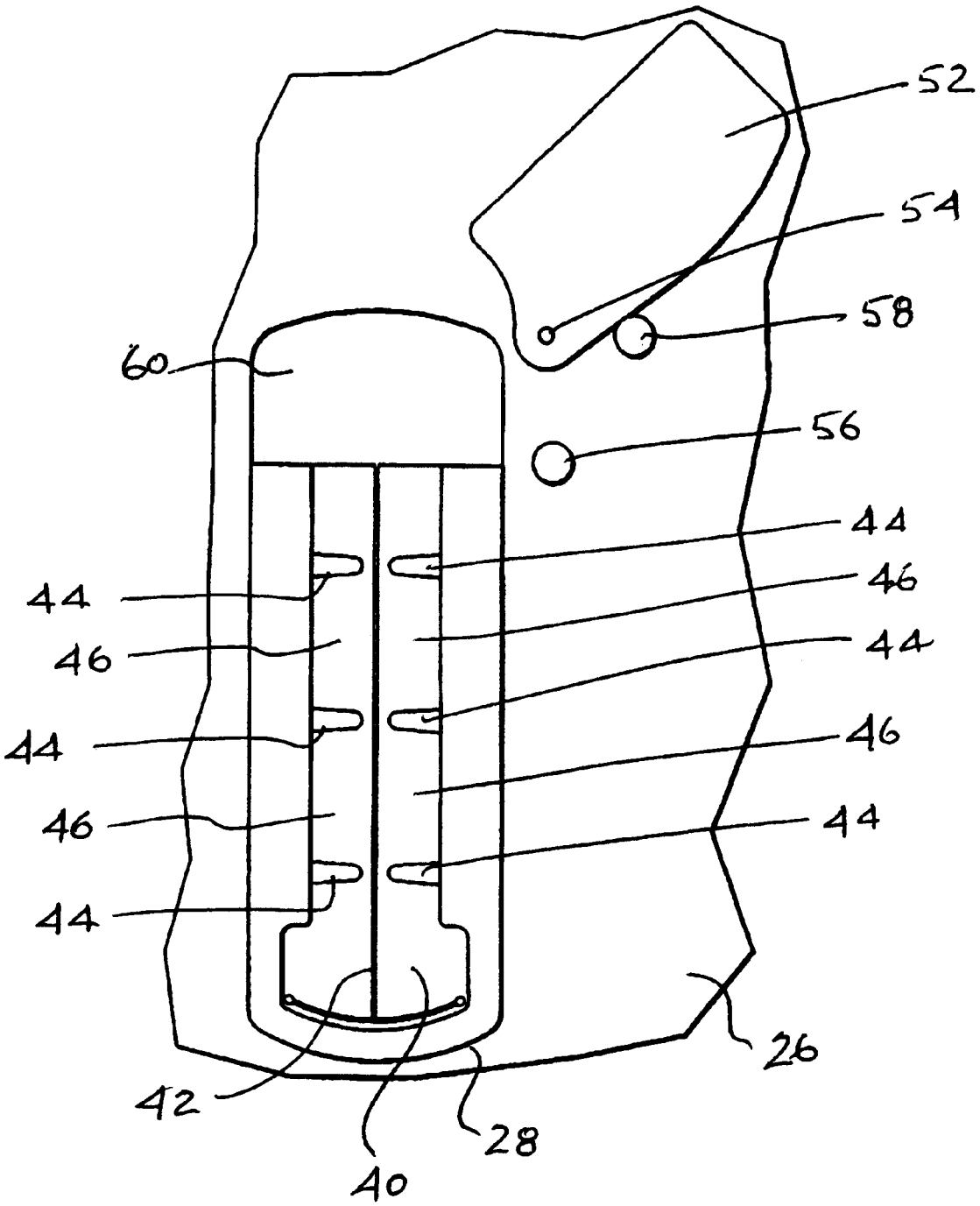
FIG. 5 is an enlarged side view of the embodiment of FIG. 4 with an opening to allow the wires and/or tubes to be positioned in the grommet.
Figure 6:
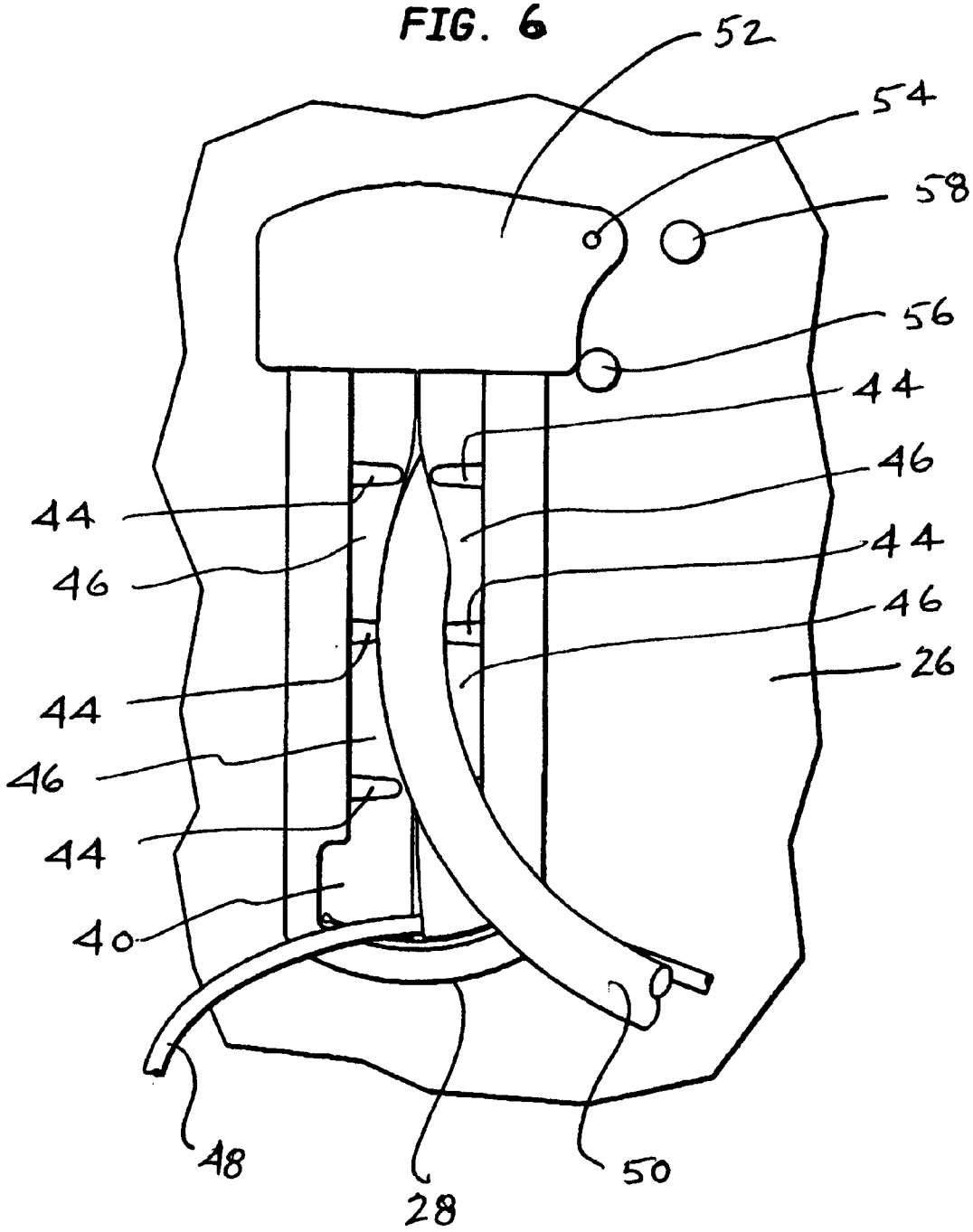
FIG. 6 is an enlarged side view of the embodiment of FIG. 4 with a tube and a wire passing through the grommet.

Turning now to FIGS. 4–6, there is shown enlarged side views of an alternate embodiment of the present invention where the grommet 28 is used in connection with an infant incubator as the infant care apparatus and where the upper edge of wall 26 is not available for access to the slit 42 as in the prior embodiment. Thus, in this embodiment, there is a door 52 that is pivotally affixed to the wall 26 by means of a pivot 54 so that it can move from its closed position of FIG. 4 to its open position of FIG. 5. As can be seen, there are a pair of stops 56, 58 to retain the movement of the door 52 to its open and closed positions, that is, in the closed position, the door 52 rests against and is restrained from further movement toward the closed position by the stop 56 and conversely, in the open position, the door 52 rests against and is restrained from further movement in the open direction by the stop 58.

Since the upper edge of the wall 26 is not available to carry out the insertion of the tube 48 or the wire 50 into the grommet 28, the use of the door 52 enables the user to have available a large opening 60 for passing the wire 48 and/or tube 50 through the wall 26 to insert the same into the infant compartment and then be able to move that wire 48 or tube 50 downwardly along the slit 42 to the desired position and retained in that position by means of the thickened ridges 44 as previously explained. As can be see, particularly in FIG. 6, in the operative state, the door 52 is closed and the wire 48 and tube 50 are positioned and supported by a particular thickened ridge 44 as explained.

The use of the door 52 in this embodiment is particularly useful for the inserting various tubes, particularly ventilator tubes, for use with an infant warmer where it is undesirable to contaminate the end of the tube and which would occur if the tube was merely pushed through the slit 42. With the use of the door 52, however, the various tubes and the like can be pushed through the wall 26 and the end of the tube maintained away from contact with a surface that could contaminate the tube. Once the end of the tube enters the infant compartment, the tube can be slid down into the grommet 28 to the desired position and the tube end has not encountered any surface that could cause contamination of that tube end.

Those skilled in the art will readily recognize numerous adaptations and modifications which can be made to the infant care apparatus of the present invention which will result in an improved control system, yet all of which will fall within the scope and spirit of the present invention as defined in the following claims. Accordingly, the invention is to be limited only by the following claims and their equivalents.

What is claimed is:

1. A grommet for allowing wires and/or tubes to pass through the wall of an infant care apparatus, said grommet comprising a flexible material adapted to be located in the wall of the apparatus, said flexible material having an elongated slit therethrough for introducing the wires and/or tubes through said slit to pass the wires and/or tubes through the wall, said grommet having a plurality of thickened ridges vertically spaced apart and extending laterally outwardly from said elongated slit, said thickened ridges adapted to retain the wires and/or tubes in a position abutting said thickened ridges, said thickened ridges adapted to support the wires and/or tubes and prevent the wires and/or tubes from sliding along said elongated slit without considerable force wherein said wires and/or tubes can be selectively positioned along said elongated slit at one of said thickened ridges.

2. A grommet as defined in claim 1 wherein said flexible material is positioned such that said slit is oriented vertically in the wall of an infant care apparatus.

3. A grommet as defined in claim 1 wherein said thickened ridges are provided in vertically aligned pairs extending outwardly from said slit.

4. A grommet as defined in claim 3 wherein said thickened ridges have increased thickness in the direction outwardly from said slit.

5. A grommet as defined in claim 4 wherein said flexible material is an elastomer.

6. An infant care apparatus, said apparatus comprising a base, an infant platform supported on said base, said apparatus including walls extending upwardly around the exterior of said platform to form an infant compartment for containing an infant, at least one of said walls having an opening, a flexible grommet covering said opening, said grommet having an elongated slit adapted to allow wires and/or tubes to pass from the exterior of said infant compartment to the interior of said infant compartment, a plurality of thickened ridges formed in said grommet, said ridges extending outwardly bidirectionally from said elongated slit and being spaced vertically apart, said ridges forming barriers to the movement of the wires and/or tubes along said elongated slit requiring an increased force to move a wire or a tube past said thickened ridges.

7. An infant care apparatus as defined in claim 6 wherein said slit is oriented vertically.

8. An infant care apparatus as defined in claim 7 wherein said ridges support said wire or tube in predetermined vertical locations along said slit.

9. An infant care apparatus as defined in claim 6 wherein said infant care apparatus is an infant incubator.

10. An infant care apparatus as defined in claim 6 wherein said opening in said wall has an upper extended opening, and said apparatus further includes a door pivotally affixed to said at least one wall, said door being movable to open and close said upper extended opening.

11. An infant care apparatus as defined in claim 10 wherein said door is pivotally affixed to said at least one wall at a point and pivots with respect to said point to open and close said upper extended opening.

* * * * *